US006116448A

United States Patent [19]

Fragos

[11] Patent Number: 6,116,448

[45] **Date of Patent: *Sep. 12, 2000**

[54] COMPRESSIBLE CONTAINER WITH ADJUSTABLE INTERNAL VOLUME

[76] Inventor: Yiannis Nicolaos Fragos, Petrokokkinou 2, 82100 Chios, Greece

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 09/030,487

[22] Filed: Feb. 25, 1998

Related U.S. Application Data

[63] Continuation of application No. 08/799,649, Feb. 10, 1997, Pat. No. 5,765,708, which is a continuation of application No. 08/373,954, Jan. 17, 1995, abandoned.

[30] Foreign Application Priority Data

Jan. 17, 1994 [GB] United Kingdom ..... 9400765

[51] Int. Cl.[7] ..... B65D 40/04

[52] U.S. Cl. ..... 220/8; 222/130

[58] Field of Search ..... 220/8; 222/130

[56] References Cited

U.S. PATENT DOCUMENTS

| | | | |
|---|---|---|---|
| 2,070,231 | 2/1937 | Katona | 220/8 |
| 3,347,154 | 10/1967 | Pech | 220/8 |
| 3,651,973 | 3/1972 | Yamauchi | 220/8 |
| 3,819,040 | 6/1974 | Coons | 220/8 |
| 4,230,234 | 10/1980 | Taylor | 220/8 |
| 4,509,656 | 4/1985 | Rosler | 220/8 |
| 5,078,287 | 1/1992 | Holmes, III | 220/8 |
| 5,765,708 | 6/1998 | Fragos | 220/8 |

*Primary Examiner*—Joseph M. Moy

[57] ABSTRACT

Apparatus and method for compressing a collapsible container to adjust an internal volume thereof in order to, for example, preserve carbonation of a liquid in the container. In one embodiment, a base section having a bottom surface and a skirt is adapted to receive and support a lower portion of the container. An upper section having a top surface and an upper skirt engages the base section and surrounds at least part of an upper portion of the container. Interlocking means are operative to interlock the base and upper sections in response to an applied compressive force, and to retain the container in a compressed state after the removal of the force. Other exemplary embodiments may utilize a threaded interlocking means, or a telescoping arrangement with a middle section between the base section and upper section, or may eliminate either the base section or the upper section and utilize interlocking means formed on the container itself.

20 Claims, 5 Drawing Sheets

COMPRESSIBLE CONTAINER WITH ADJUSTABLE INTERNAL VOLUME

This case is a continuation of Ser. No. 08/799,649 filed Feb. 10, 1997, U.S. Pat. No. 5,765,708 which is a continuation of Ser. No. 08/373,954 filed Jan. 17, 1995, abandoned.

FIELD OF THE INVENTION

This invention relates to a unit for compressing and retaining a container in a compressed state and particularly relates to the compression of bottles containing carbonated liquids.

BACKGROUND OF THE INVENTION

Today supermarkets and shops sell products such as carbonated drinks in increasingly large volumes. The containers, which are usually plastic bottles, generally hold volumes of up to around 3 liters of liquid although there is no reason why larger containers cannot be used.

Perhaps the main advantage to the customer and producer with respect to buying and selling this type of product in bulk, say 3 liter bottles, is the reduction in overall production costs and thereby sale prices of the product in comparison to the same product in smaller containers. Bulk containers are easier to handle and cheaper to make than the large number of small bottles or cartons used to hold a similar volume of product.

A serious problem, however, with buying carbonated drinks in large containers is that once the container has been opened and a quantity of the liquid removed, the quality i.e. the "fizzyness" of the product remaining in the container deteriorates over a relatively short period of time. Eventually, the quality deteriorates to the point where there is only a negligible amount of carbon dioxide remaining in the liquid, the majority of the carbon dioxide being in the gaseous atmosphere of the bottle. This is because of the change in gas/liquid pressure equilibrium within the container resulting from the volume of liquid which had been poured from the container.

Therefore despite saving a small amount of money through buying the liquid in a bulk container, often unless all the liquid is consumed in a short period of time, say 6–12 hours, the liquid remaining in the container becomes undrinkable and is subsequently disposed of. Hence, by throwing away the residual liquid all the money saved by buying in bulk is lost because the liquid was not used quickly enough.

SUMMARY OF THE INVENTION

According to the present invention there is provided a container capable of being compressed to reduce its effective volume and an adjustable interlocking means which is adapted to adjust the volume of the container.

Also according to the invention there is provided an adjustable interlocking means adapted to retain and compress a container in order to adjust the effective volume of the container.

In accordance with one aspect of the invention, the interlocking means may include at least two sections one of which may comprise the container.

It is to be understood that any appropriate locking means may be used to interlock the sections and that the locking means disclosed here below are to be considered merely as examples for use with the units described in this invention. Examples of the locking mechanism include the use of interlocking projections on each section, screw mechanisms or by adjustable external locking means.

Preferably the container holds a liquid and most preferably said liquid is a carbonated drink.

In a first embodiment of the invention the container is a bottle and said interlocking means comprises a base section with a skirt, and an upper section which comprises a top and a skirt. The base and upper sections are sized to enable one skirt to fit inside the other skirt. Preferably the base and upper sections are cylindrical such that the diameter of one of the base or top is greater than the diameter of the other of the base or top.

Most preferably the top is annular with a central hole. The section with the larger diameter comprises at least one line of projections on the inner surface of its skirt and the section with the smaller diameter comprises at least one line of outwardly facing projections. The two sets of projections are situated to enable the smaller diameter portion to slide inside the larger portion and to allow the two sets of projections to interlock the two sections relative to each other.

For example, if the top has a larger diameter than the base, in use a bottle is placed inside the base and the upper section is placed over the top of the bottle such that the neck of the bottle fits through the central hole in the top.

After removing an amount of liquid from the bottle and before replacing the cap, an external force is applied to the top, either manually or by other means, to compress the bottle. The applied force is sufficiently large to compress the bottle to an extent that the liquid contained therein is within a short distance from the neck of the bottle. The two sections are subsequently interlocked thereby maintaining only a small headspace in the bottle and the cap is replaced. This prevents all significant loss of pressure in the bottle and as such maintains the majority of the carbon dioxide in the liquid.

The bottle is preferably weakened in specific areas on production to enable compression.

A number of alternative embodiments of this invention are also described. For example, the compression means may comprise more than two sections which telescopically interfit.

A further alternative arrangement is where the unit comprises either a base or a top section as described previously and said base or top section has inwardly facing locking sections which are interlockable with projections on the outside of said bottle.

In a still further embodiment the unit may comprise an interlocking screw system comprising, for example, an upper section with a screw thread on the inner surface of its skirt and a base section with a screw thread on the outer surface its skirt, the two screw threads being interengageable. In this instance pressure is applied to the bottle held within the unit by the screwing action.

Preferably the bottle and unit may be sold in a kit with a reusable bottle or as a complete disposable unit or alternatively in separate parts.

The present invention ensures that the properties of carbonated drinks remain the same, irrespective of the quantity remaining in the bottle, that is, it ensures that the "fizzyness" remains regardless of how much of the bottle's contents are consumed. The invention is particularly effective for larger bottles, such as those holding two liters or more, which are also the containers where the greatest problem of lost carbonation is experienced. However, the invention can also be utilized with bottles or other containers of any desired size or shape.

The present invention allows the effective use of high-volume containers for carbonated liquids. This can provide increased profit margins for beverage distributors, by reducing the necessity for a wide variety of different bottle sizes. The use of high-volume collapsible containers thus provides easier inventory control, lower production and operating costs, and a reduction in consumption of raw materials. In accordance with the invention, the volume of the collapsible container can be reduced as the contents are consumed, thereby reducing the amount of storage space required for the container while also maintaining the flavor and fizzy quality of the contents indefinitely.

Specific embodiments of the invention will now be described by way of example with reference to the accompanying drawings.

DETAILED DESCRIPTION

Figure 1A:
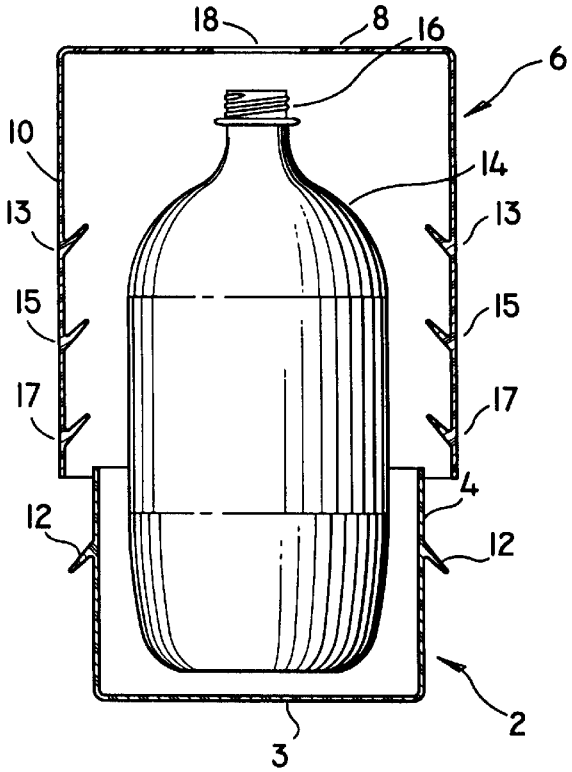
FIGS. 1*a*, 1*b*, 1*c* and 1*d* illustrate the compression of a bottle by a compression unit in accordance with the invention.

Referring to FIGS. 1*a*, 1*b*, 1*c* and 1*d*, an exemplary compression unit in accordance with the present invention comprises a base 2 with a bottom 3 and a skirt 4 and an upper section 6 with an annular top 8 and skirt 10. Fixed to the outer surface of skirt 4 is a single horizontal intermittent line of projections 12. Fixed to the inner surface of skirt 10 are three horizontal lines of intermittent projections 13, 15 and 17.

In use as shown in FIG. 1*a*, a bottle 14 is inserted into base 2 and the upper section 6 is placed over bottle 14, the neck of the bottle 16 passing through a hole 18 in annular top 8.

Figure 1B:
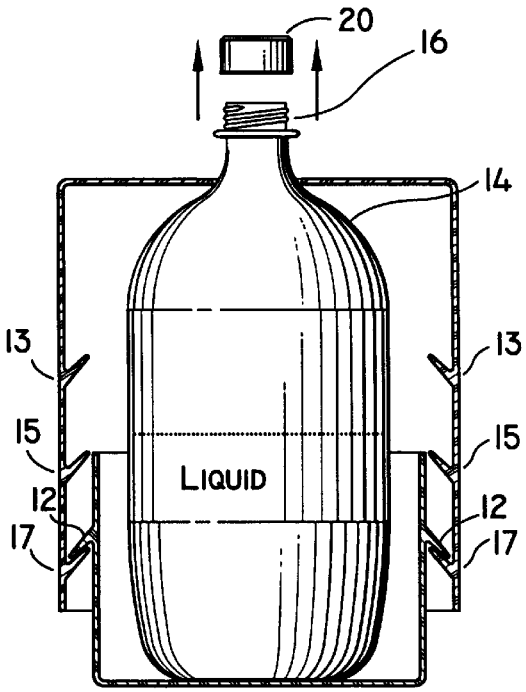

FIG. 1*b* shows bottle 14 arranged within base 2 and upper section 6. A cap 20 is adapted to engage the neck 16 of bottle 14 in order to prevent escape of the bottle contents. In FIG. 1*b*, cap 20 is removed from neck 16, and a portion of the contents, in this example a liquid, have been poured out or otherwise removed from bottle 14. A dashed line indicates the level of liquid remaining in bottle 14. Although cap 20 is shown as a separate, fully removable cap in FIGS. 1*a* to 1*d*, the cap 20 could also be attached to the neck 16 of container 14 by, for example, a suitable plastic connecter.

Figure 1C:
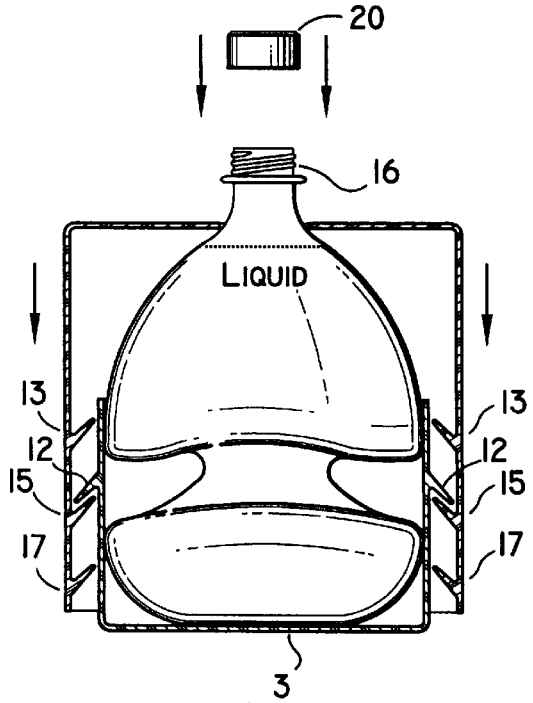
Figure 1D:
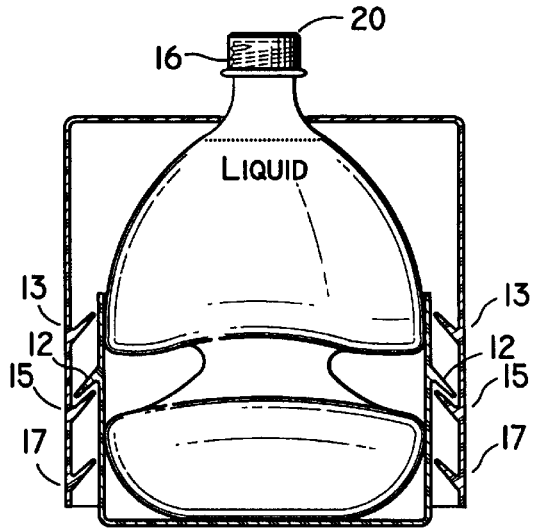

FIGS. 1*c* and 1*d* show bottle 14 compressed in accordance with one embodiment of the invention. After pouring an amount of liquid from bottle 14, and before replacing cap 20 on neck 16, the bottle 14 is compressed so as to contain only a very small headspace of air. The headspace of air is denoted by the portion of the bottle internal volume above the dashed line in FIG. 1*c*.

The compression of bottle 14 is carried out in this example by applying an external force to annular top 8. Once a sufficiently large force has been applied to compress the bottle 14 to an extent that the liquid contained therein is within a short distance from the neck 16 of the bottle, sections 2 and 6 are in the case of FIG. 1*d* interlocked by means of projections 12 and 15. This maintains a small headspace in the bottle and thereby prevents all significant loss of pressure in the bottle and as such maintains the majority of the carbon dioxide in the liquid.

After each subsequent removal of liquid from bottle 14 the above procedure is repeated thereby increasingly compressing the bottle and decreasing the effective volume thereof.

Figure 2:
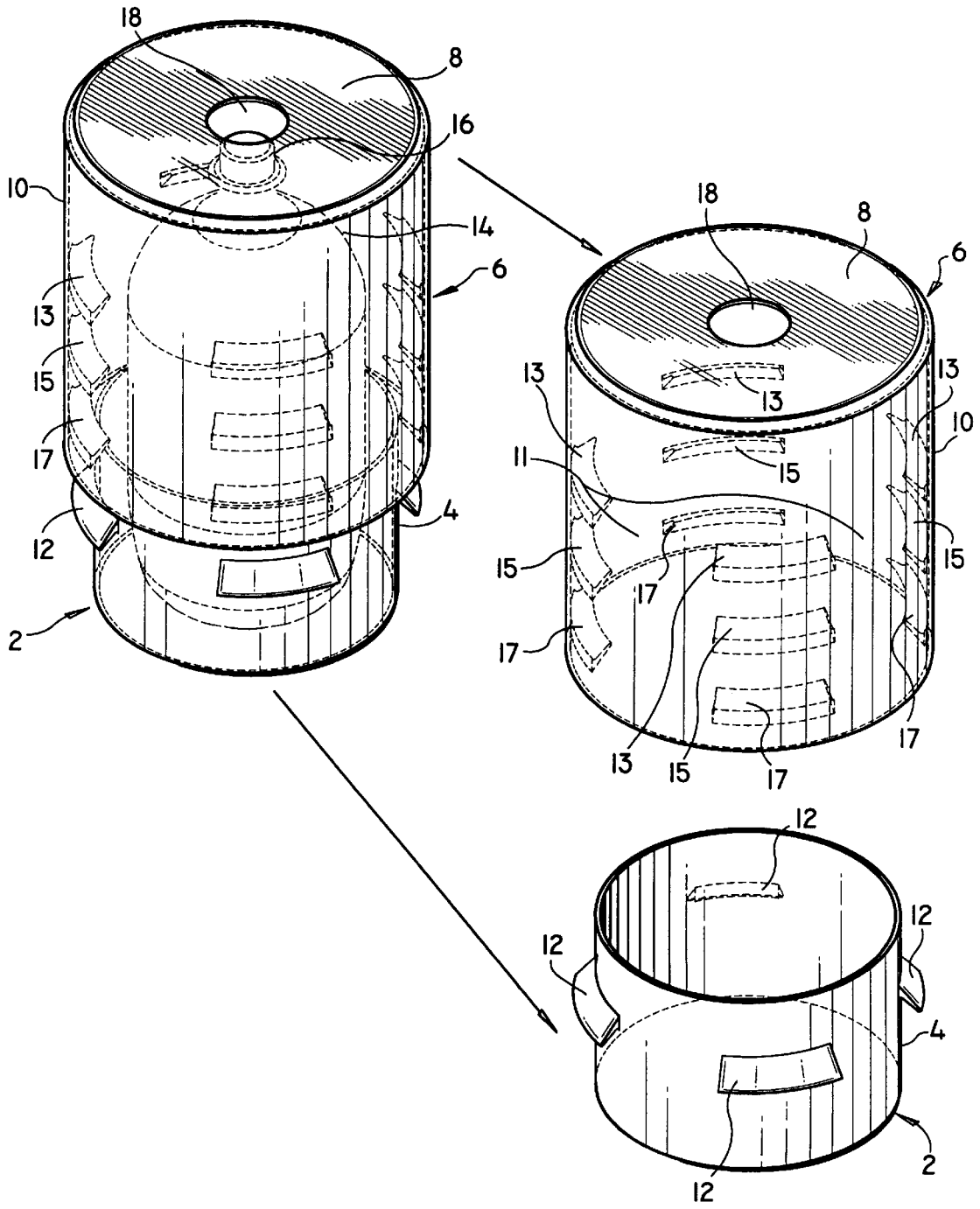
FIG. 2 shows an example of the interlocking projections on a two part compression unit.

As shown in FIG. 2, skirt 10 comprises vertical channels 11 between neighboring projections which enables base 2 to move into skirt 10 and enables the projections of both sections to interlock as shown in FIG. 1*d*. FIG. 2 illustrates the upper section 6 with projections 13, 15 and 17 arranged on inner side and back surfaces thereof. Projections are also located on inner front surfaces. Similarly, base section 2 includes projections on outer side, back and front surfaces. It should be emphasized that these arrangements and configurations of projections are exemplary only, and numerous alternative projections will be apparent to those skilled in the art.

In an alternative embodiment of the compression unit shown in FIGS. 1*a* through 1*d*, the collapsible container 14 and upper section 6 may be connected together or otherwise attached at, for example, the neck 16 of container 14. Such an embodiment may be configured as shown in FIG. 1*b*, with the addition of a suitable attachment means securing container 14 to upper section 6, or may be configured with container 14 and upper section 6 formed as a single part.

Figure 3:
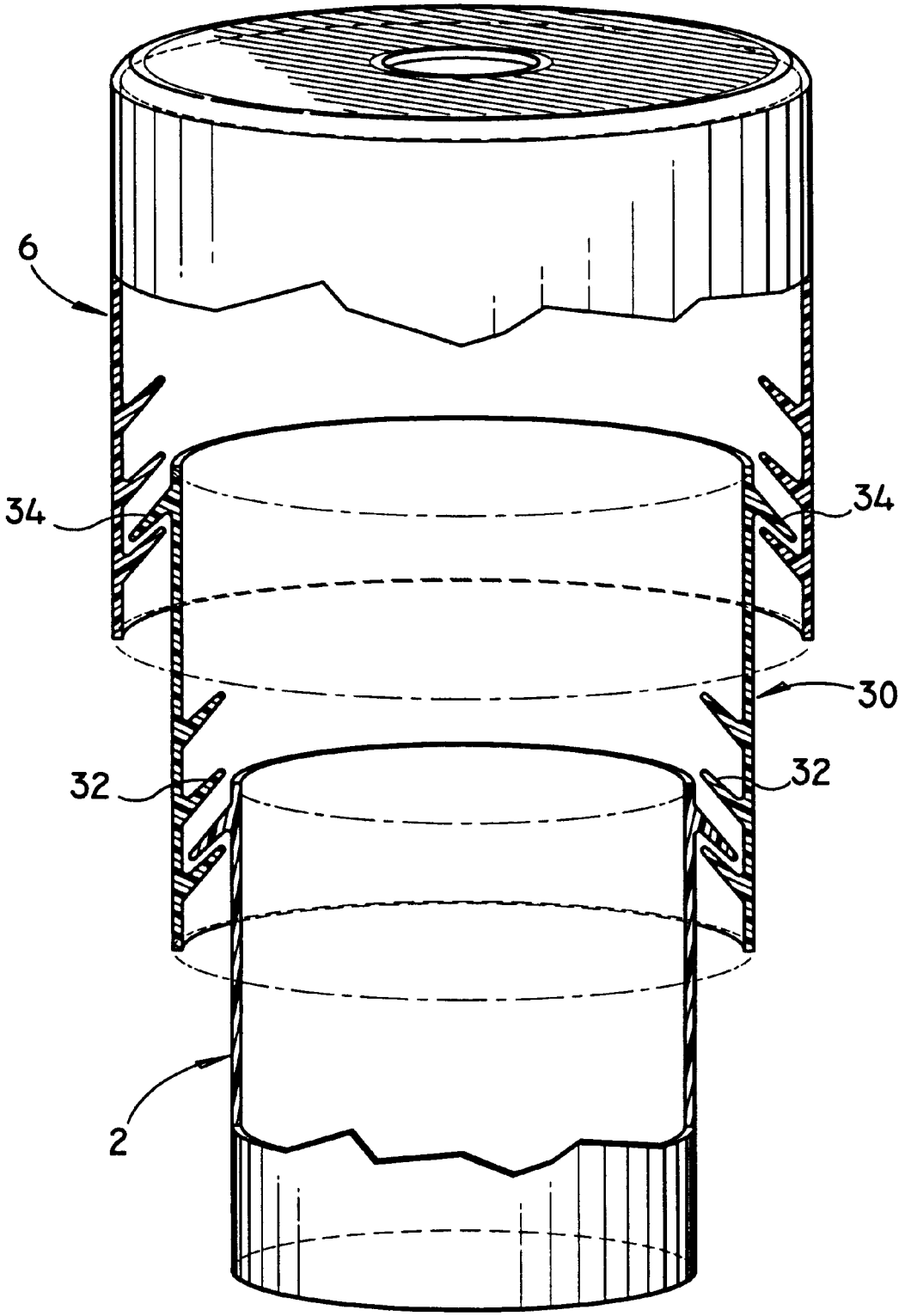
FIG. 3 shows an interlocked three part compression unit.

An alternative compression unit in accordance with the present invention includes three or more sections which may telescopically interfit. FIG. 3 shows a unit as described above but with the addition of middle section 30. The insertion of section 30 enables the user to compress his/her container to a smaller volume if desired. In this instance section 30 comprises projections 32 and 34 which interlock with projections on sections 2 and 6, respectively.

Figure 4A:
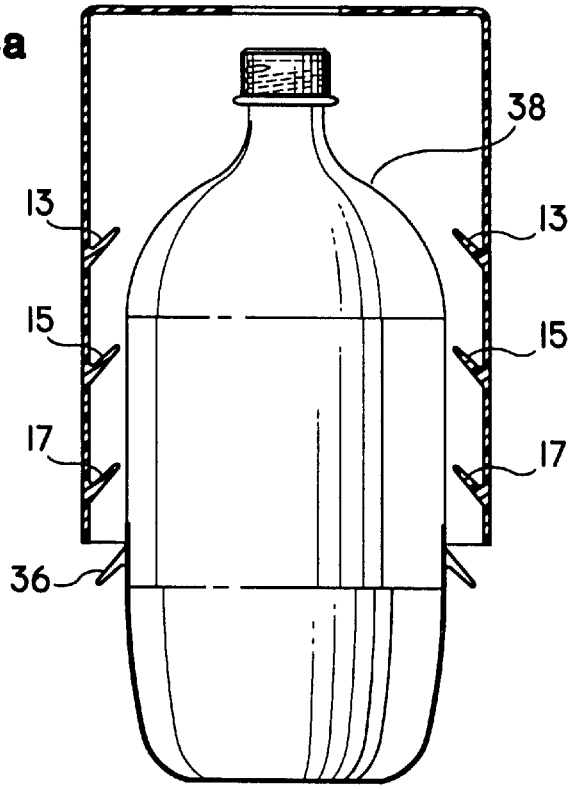
FIGS. 4*a* and 4*b* shows two alternative units for compressing a bottle.
Figure 4B:
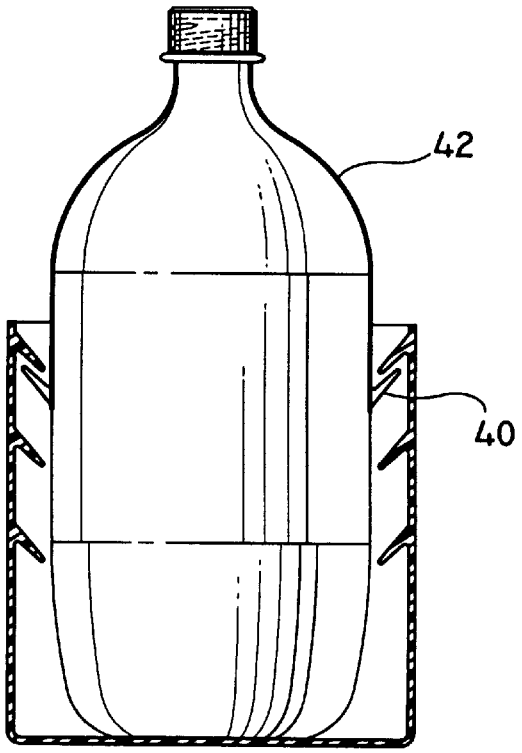

Further embodiments of the invention are shown in FIGS. 4*a* and 4*b*. These embodiments utilize a compression unit which includes either a base section or an upper section as described previously, and in which the base section or upper section includes inwardly-facing projections which are interlockable with corresponding projections on the outside of the collapsible container. In FIG. 4*a* the projections 13, 15 and 17 on the upper section 6 interconnect directly with projections 36 on a bottle 38 and in FIG. 4*b* the projections on the base section interconnect with projections 40 on bottle 42. The bottle 38 in FIG. 4*a* includes a flexible upper portion, shown by narrow lines, and a rigid lower portion, shown by thicker lines and having projections on an outer surface thereof. The bottle 42 in FIG. 4*b* includes a rigid upper portion, shown by thicker lines, and a flexible lower portion, shown by narrow lines. The rigid upper portion includes projections 40 which interlock with corresponding projections on the base section.

The embodiments of FIGS. 4*a* and 4*b* may be configured with either the upper section in FIG. 4*a* attached to container 38 or the base section in FIG. 4*b* attached to container 42. In such embodiments, the containers 38, 42 may be integrally formed with the upper section or base section, respectively, such that the combined compression means and collapsible container represent a one-piece unit. Apparatus in accordance with the present invention thus include one-piece units as well as multiple-piece units.

Figure 5:
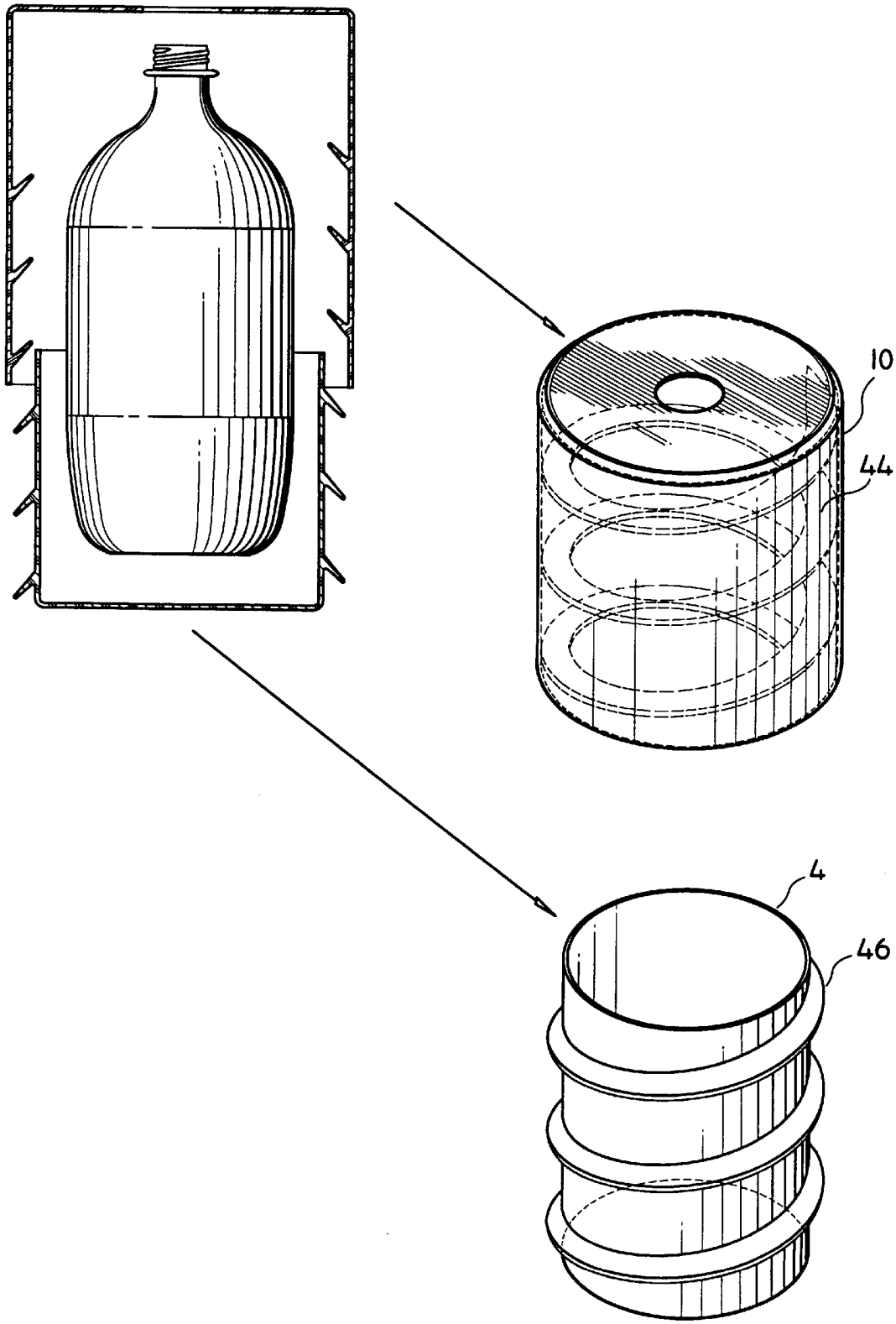
FIG. 5 shows a unit with a screw threaded locking system.

A further alternative embodiment of a compression unit in accordance with the present invention utilizes an interlocking screw system. The screw system comprises, for example, an upper section with a screw thread on an inner surface of its skirt and a base section with a screw thread on the outer surface of its skirt, and the two screw threads are interengageable. In such an embodiment, a compressing pressure is applied to the bottle by the screwing action. This further alternative embodiment is illustrated in FIG. 5 which shows a two part unit as in FIG. 1 but in this instance rather than intermittent projections the interlocking means is an interlocking screw wherein screw thread 44 on the inner surface of skirt 10 interlocks with screw thread 46 on the outer face of skirt 4.

In the embodiments described above, a vacuum may be drawn in the gap between the unit and the bottle, such that the unit and bottle as a whole comprises a vacuum flask. Also, the bottle may comprise a thermally insulating material thereby maintaining the temperature of the contents of the bottle enabling the bottle to, for example, hold a hot liquid such as tea or coffee at a picnic wherein the container can be sized in accordance with the volume of liquid which is to be held therein.

The compression units and bottles or other collapsible containers in accordance with the present invention may be formed of plastic or any other suitable material, using known techniques.

In a further embodiment, in which collapsible container 14 is designed to hold a carbonated liquid such as a soft drink, the contents may be supplied in a condensed form such as a tablet. The contents could be distributed to customers with the compression unit and collapsible container in its fully compressed state. The customer would then decompress the collapsible container and, for example, add water to the soft drink tablet to obtain the desired full container of carbonated soft drink. After a portion of the drink is consumed, the collapsible container is compressed using the compression unit in the manner previously described. Such an embodiment provides a substantial advantage in terms of reduced distribution costs, because carbonated drinks can be distributed without water and in reduced-volume collapsible containers compressed in accordance with the invention.

It should be noted that the compression unit and/or collapsible container of the present invention may be suitably configured to provide any of a number of alternative shapes. For example, the outer section and base section shapes shown in FIGS. 1*a* and 1*d* may be altered to accommodate the shapes of various existing containers.

As can be seen from the above, there are a wide range of alternative embodiments relating to this inventive concept and it is understood that the above are merely examples of units which might be utilized for this invention.

I claim:

1. An apparatus comprising:

a compressible container for storing a quantity of a substance, the container having a first end and a second end, wherein the substance is removed from or added to the container via an opening near one of the ends of the container, at least a portion of the container having a flexible surface such that an effective volume of the container can be altered; and a retainer including at least one of a first section and a second section, the first section surrounding at least a portion of the first end of the container and the second section surrounding at least a portion of the second end of the container, and at least one of the first and second sections having an opening therein through which the substance passes when being removed from or added to the container, wherein the effective volume of the container is altered by applying a force thereto, such that the container is altered in height, upon application of the force, relative to its height prior to application of the force, and wherein the retainer is operative to retain the container in a particular state after removal of the force, the particular state corresponding to a particular container volume not subject to further alteration based on an amount of the substance removed from or added to the container.

2. The apparatus of claim 1 wherein the substance is a liquid.

3. The apparatus of claim 1 wherein the retainer further includes:

at least a first set of projections arranged on a surface of the first section; and a second set of projections arranged on a surface of the container, wherein at least one of the projections in the first set interlocks with a corresponding projection in the second set in response to the force applied to the container.

4. The apparatus of claim 1 wherein the container is a bottle and the first section and the bottle are attached at a neck of the bottle.

5. The apparatus of claim 1 wherein the retainer further includes:

the second section having at least a first set of projections arranged on a surface thereof; and a second set of projections arranged on a surface of the container, wherein at least one of the projections in the first set interlocks with a corresponding projection in the second set in response to the force applied to the container.

6. The apparatus of claim 1 wherein the retainer further includes:

the second section having a bottom surface and a base skirt projecting in an upward direction from the bottom surface, the second section adapted to support a lower portion of the container;

the first section having a top surface and an upper skirt projecting in a downward direction from the top surface, the top surface including an aperture adapted to receive an upper portion of the container; and means for interlocking the second section and the first section after application of the force to the container.

7. The apparatus of claim 6 wherein the interlocking means further include:

a first set of intermittent projections arranged on a surface of the second section skirt; and a second set of intermittent projections arranged on a surface of the first section skirt, wherein corresponding projections in the first and second sets of projections are operative to interlock upon application of the force to the container via the first section when the second section skirt is engaged with the first section skirt.

8. The apparatus of claim 6 wherein the interlocking means further include:

a first screw thread arranged on a surface of the second section skirt; and a second screw thread arranged on a surface of the first section skirt, wherein the first and second screw thread are engaged to interlock the second section and the first section.

9. The apparatus of claim 6 wherein the interlocking means further include a middle section having a first set of projections adapted to interlock the second section to a lower portion of the middle section, and a second set of projections adapted to interlock the first section to an upper portion of the middle section.

10. The apparatus of claim 1 wherein the retainer further includes:

the second section having a bottom surface and a skirt, wherein the second section is adapted to receive and support the container; and means for interlocking the second section and the container in response to the force applied to the container.

11. The apparatus of claim 10 wherein the interlocking means further include:

a first set of projections on a surface of the second section skirt; and a second set of projections on a surface of the container wherein corresponding projections in the first and second sets interlock when the container is disposed within the second section under the applied force.

12. The apparatus of claim 1 wherein the retainer further includes means for interlocking the first section and the container in response to the force applied to the container.

13. The apparatus of claim 12 wherein the interlocking means further includes:

a first set of projections on a surface of the first section; and a second set of projections on a surface of the container, wherein corresponding projections in the first and second sets interlock when the container is disposed within the first section under the applied force.

14. An apparatus for at least one of compressing and decompressing a compressible container suitable for storing a quantity of a substance, to thereby adjust an effective volume of the container, the container having a first end and a second end, wherein the substance is removed from or added to the container via an opening near one of the ends of the container, the apparatus comprising:

a retainer having at least one of a first section and a second section, the first section surrounding at least a portion of the first end of the container, the second section surrounding at least a portion of the second end of the container, and at least one of the first and second sections having an opening therein through which the substance passes when being removed from or added to the container;

the retainer including projections arranged on a surface of the at least one of the first section and the second section, wherein the projections are operative to retain the container in a particular state in response to a force applied thereto, such that the container is thereby altered in height relative to its height prior to application of the force, the particular state corresponding to a particular container volume not subject to further alteration based on an amount of the substance removed from or added to the container.

15. The apparatus of claim 14 wherein the substance is a liquid.

16. A method for at least one of compressing and decompressing a container to adjust an effective volume thereof, comprising:

providing a compressible container suitable for storing a quantity of a substance, the container having a first end and a second end, wherein the substance is removed from or added to the container via an opening near one of the ends of the container; and surrounding at least a portion of the opening with a retainer having at least one of a first section and a second section, the first section surrounding at least a portion of the first end of the container and the second section surrounding at least a portion of the second end of the container, at least one of the first and second sections having an opening therein through which the substance passes when being removed from or added to the container, wherein the effective volume of the container is altered by applying a force thereto, such that the container is altered in height, upon application of the force, relative to its height prior to application of the force, and wherein the retainer is operative to retain the container in a particular state after removal of the force, the particular state corresponding to a particular container volume not subject to further alteration based on an amount of the substance removed from or added to the container.

17. The method of claim 16 wherein the substance is a liquid.

18. An apparatus comprising:

a compressible container for storing a quantity of a substance, the container having a bottom and a top, wherein the substance is poured from the top of the container, at least a portion of the container having a flexible surface such that the container can be compressed to reduce an effective volume thereof; and a retainer including an upper section, the upper section surrounding at least a portion of the top of the container and having an opening therein through which the substance passes when poured from the top of the container, wherein the container can be compressed by applying a compressive force to the top of the container via the upper section of the retainer, such that the compressed container is thereby reduced in height relative to its uncompressed height, and wherein the retainer is operative to retain the container in a compressed state after removal of the compressive force, the compressed state corresponding to a particular container volume not subject to further adjustment based on an amount of the substance in the container.

19. An apparatus for compressing a compressible container suitable for storing a quantity of a substance, to thereby adjust an effective volume of the container, the container having a bottom and a top, such that the substance is poured from the top of the container, the apparatus comprising:

a compression unit having at least an upper section, wherein the upper section is adapted to receive and enclose at least a portion of the top of the container, and wherein the upper section includes an opening therein through which the substance passes when poured from the top of the container;

the compression unit including projections arranged on a surface of the upper section, wherein the projections are operative to retain the container in a compressed state in response to a compressive force applied to the top of the container via the upper section, such that the container is thereby reduced in height relative to its uncompressed height, the compressed state corresponding to a particular container volume not subject to further adjustment based on an amount of the substance in the container.

20. A method of compressing a container to adjust an effective volume thereof, comprising:

providing a compressible container suitable for storing a quantity of a substance, the container having a bottom and a top, such that the substance is poured from the top of the container; and surrounding at least a portion of the top of the container with a compression unit, the compression unit including an upper section having an opening therein through which the substance passes when poured from the top of the container, wherein the container can be compressed by applying a compressive force to the top of the container via the upper section of the compression unit, such that the compressed container is thereby reduced in height relative to its uncompressed height, and wherein the compression unit is operative to retain the container in a compressed state after removal of the compressive force, the compressed state corresponding to a particular container volume not subject to further adjustment based on an amount of the substance in the container.

* * * * *